US006375310B1

(12) United States Patent
Arakawa et al.

(10) Patent No.: US 6,375,310 B1
(45) Date of Patent: Apr. 23, 2002

(54) INK JET HEAD, MANUFACTURING METHOD THEREFOR, AND INK JET RECORDING APPARATUS

(75) Inventors: Katsuji Arakawa, Suwa; Hiroshi Koeda, Fujimi-machi, both of (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/180,650

(22) PCT Filed: Mar. 25, 1998

(86) PCT No.: PCT/JP98/01323

§ 371 Date: Nov. 12, 1998

§ 102(e) Date: Nov. 12, 1998

(87) PCT Pub. No.: WO98/42514

PCT Pub. Date: Oct. 1, 1998

(30) Foreign Application Priority Data

Mar. 26, 1997 (JP) ..... 9-74228

(51) Int. Cl.[7] ..... B41J 2/04
(52) U.S. Cl. ..... 347/54
(58) Field of Search ..... 347/54, 40, 20, 347/44, 71, 49, 43, 47, 68, 69, 70, 72, 50, 27, 63; 399/261; 361/700; 29/890.1; 310/328–330

(56) References Cited

U.S. PATENT DOCUMENTS 4,429,322 A * 1/1984 Dressler et al. ..... 347/47
4,703,333 A * 10/1987 Hubbard ..... 347/40
5,107,586 A * 4/1992 Eichelberger et al. ..... 29/830
5,563,634 A * 10/1996 Fujii et al. ..... 347/54
5,600,747 A * 2/1997 Yamakawa et al. ..... 385/59
5,604,521 A * 2/1997 Merkel et al. ..... 347/47
5,757,402 A * 5/1998 Günther et al. ..... 347/49
6,113,218 A * 9/2000 Atobe et al. ..... 347/54

FOREIGN PATENT DOCUMENTS

JP 6-71882 3/1994 ..... 347/47
JP 7-323541 12/1995

* cited by examiner

*Primary Examiner*—Raquel Yvette Gordon
(74) *Attorney, Agent, or Firm*—Mark P. Watson

(57) ABSTRACT

An ink jet head in which a multi-nozzle structure is attained, and highly accurate alignment of ink jet head chips is realized, a method for manufacturing the ink jet head, and a recording apparatus on which the ink jet head is mounted. Guide protrusions (141) for alignment of ink jet head chips (41) are formed in an ink jet head chip bonded surface (134) of a nozzle plate (133), the ink jet head chips (41) are aligned by inserting the guide protrusions (141) of the nozzle plate (133) into guide grooves (51) of nozzle surfaces (42) of the ink jet head chips (41), and the nozzle plate (133) and the respective ink jet head chips (41) are bonded with each other by a bonding agent.

11 Claims, 14 Drawing Sheets

INK JET HEAD, MANUFACTURING METHOD THEREFOR, AND INK JET RECORDING APPARATUS

TECHNICAL FIELD

The present invention relates to an ink jet head which is a main part of an ink jet head recording apparatus ejecting ink drops to thereby attach the ink drops onto recording paper only when recording is required; a manufacturing method therefor; and the ink jet recording apparatus.

BACKGROUND TECHNIQUE

An ink jet recording apparatus has many advantages in that noise is extremely small at the time of recording, printing can be performed at a high speed, freedom of ink is high so that inexpensive cheap ordinary paper can be used, and so on. Of the apparatus, a so-called ink-on-demand system ejecting ink drops only when recording is required is becoming the mainstream currently because it is not necessary to recover ink drops unnecessary for recording.

One type of ink jet recording apparatus adopting this ink-on-demand system has an ink jet head in a system using electrostatic power (e.g. JP-A-6-71882) as a driving system for ejecting ink. This system has advantages in that it is small in size, high in density, high in printing quality and long in life. This ink jet head of the system using electrostatic power is manufactured by bonding an Si substrate finished by micro-machining technique, with a glass having electrodes, as disclosed in the above JP-A-6-71882. A plurality of chips of ink jet heads are formed in a lump on a single substrate, and separated from each other by dicing, so that the individual ink jet heads can be obtained.

However, as an ink jet recording apparatus has become to perform printing in colors, and printing at a high speed, it has become necessary that an ink jet head has a multi-nozzle structure. When this multi-nozzle structure is realized by arranging conventional one-nozzle-line head chips in parallel in a plane so as to form a plurality of nozzle lines, the size of head chips as a whole becomes large. That is, when an ink jet head having a plurality of nozzle lines is formed in a lump on a single substrate, the number of head chips extracted from the single substrate is reduced because the head chip size becomes large. Accordingly, the cost of an ink jet head is increased.

DISCLOSURE OF THE INVENTION

It is therefore an object of the present invention to provide an ink jet head in which a multi-nozzle structure is realized without increasing the size and without increasing the cost.

In addition to the above-mentioned object, it is another object of the invention to provide an ink jet head in which highly accurate alignment of ink jet head chips is realized when a multi-nozzle structure is realized.

An ink jet head according to the present invention is constituted by a stacked body in which a plurality of ink jet head chips are stacked one on another at predetermined intervals, each of the chips including a plurality of nozzle holes for ejecting ink drops, ejection chambers connected to the nozzle holes respectively, a diaphragm constituting at least one wall of each of the ejection chambers, and a driving means for producing transformation in the diaphragm. Further, the driving means is constituted by an electrode for transforming the diaphragm by electrostatic power, the diaphragm being formed on an Si substrate. Thus, the ink jet head is applied to a driving method of the electrostatic system.

According to the present invention, an ink jet head is thus configured by stacking ink jet head chips one on another, so that the ink jet head can have a multi-nozzle structure, and can cope with color printing and high-speed printing. In addition, since it will suffice if small ink jet head chips are merely stacked one on another, the number of ink jet head chips which can be obtained from one substrate is increased. Therefore, since it will suffice if normal ink jet head chips are selected and assembled, the yield is improved. In addition, since the area of the nozzle surface in which nozzle holes are arranged becomes small, the movement of an ink jet head at the time of printing can be reduced and the space efficiency inside the printer can be improved. Further, since ink jet head chips are stacked one on another at predetermined intervals, it is possible to avoid the influence of scattering in the outer size of the ink jet head chips and in the thickness of a bonding agent.

In the above ink jet head according to the present invention, a plurality of grooves for acting as guides upon stacking of the ink jet head chips are formed in an end surface on the nozzle hole side of or in each of opposite side surfaces of each of the ink jet head chips so that the alignment of the ink jet head chips is performed with these grooves as guides. Accordingly, it is possible to make alignment of ink jet chips easily and with high accuracy.

An ink jet head according to the present invention comprises a stacked body in which a plurality of ink jet head chips are stacked one on another at predetermined intervals, each of the ink jet head chips including a plurality of aperture portions for allowing ink drops to flow therethrough, ejection chambers connected to the aperture portions respectively, a diaphragm constituting at least one wall of each of the ejection chambers, and a driving means for producing transformation in the diaphragm, wherein a nozzle plate having a plurality of nozzle holes for ejecting the ink drops from the aperture portions is bonded with the stacked body. The driving means is constituted by an electrode for transforming the diaphragm by electrostatic power, and the diaphragm is formed on an Si substrate. Thus, the ink jet head is applied to a driving method of the electrostatic system.

According to the present invention, since a nozzle plate is adopted, the effect that the position accuracy of nozzle holes is improved is obtained in addition to the above-mentioned effects.

In the ink jet head using a nozzle plate according to the present invention, a plurality of guiding grooves are provided in an end surface on the aperture portion side of each of the ink jet head chips, and protrusion portions to be inserted into the grooves are provided in the nozzle plate. This nozzle plate functions as an alignment jig and the alignment of the ink jet head chips is made easier.

Further, in an ink jet head manufacturing method for manufacturing an ink jet head according to the present invention, in the case where a plurality of grooves are provided as guides for perform stacking in an end surface on the nozzle hole side of or in each of opposite side surfaces of each of the ink jet head chips, the plurality of grooves are produced by anisotropic etching, and alignment of the ink jet head chips is performed by inserting alignment members of an alignment jig into the plurality of grooves. Accordingly, the alignment of the ink jet head chips is made easier.

Further, in an ink jet head manufacturing method for manufacturing an ink jet head according to the present invention, in the case where a plurality of guiding grooves are provided in an end surface on the aperture portion side of each of the ink jet head chips and protrusion portions to be inserted into the grooves are provided in the nozzle plate, the grooves and the protrusion portions are produced by anisotropic etching, and alignment of the ink jet head chips is performed by inserting the protrusion portions into the plurality of grooves. The nozzle plate performs a role as an alignment jig to thereby make the alignment of ink jet head chips easier.

In addition, an ink jet recording apparatus according to the present invention is mounted with the above-mentioned ink jet head to thereby realize a recording apparatus which can cope with color printing and high-speed printing.

THE BEST MODE FOR CARRYING OUT THE INVENTION

Embodiment 1

Figure 1:
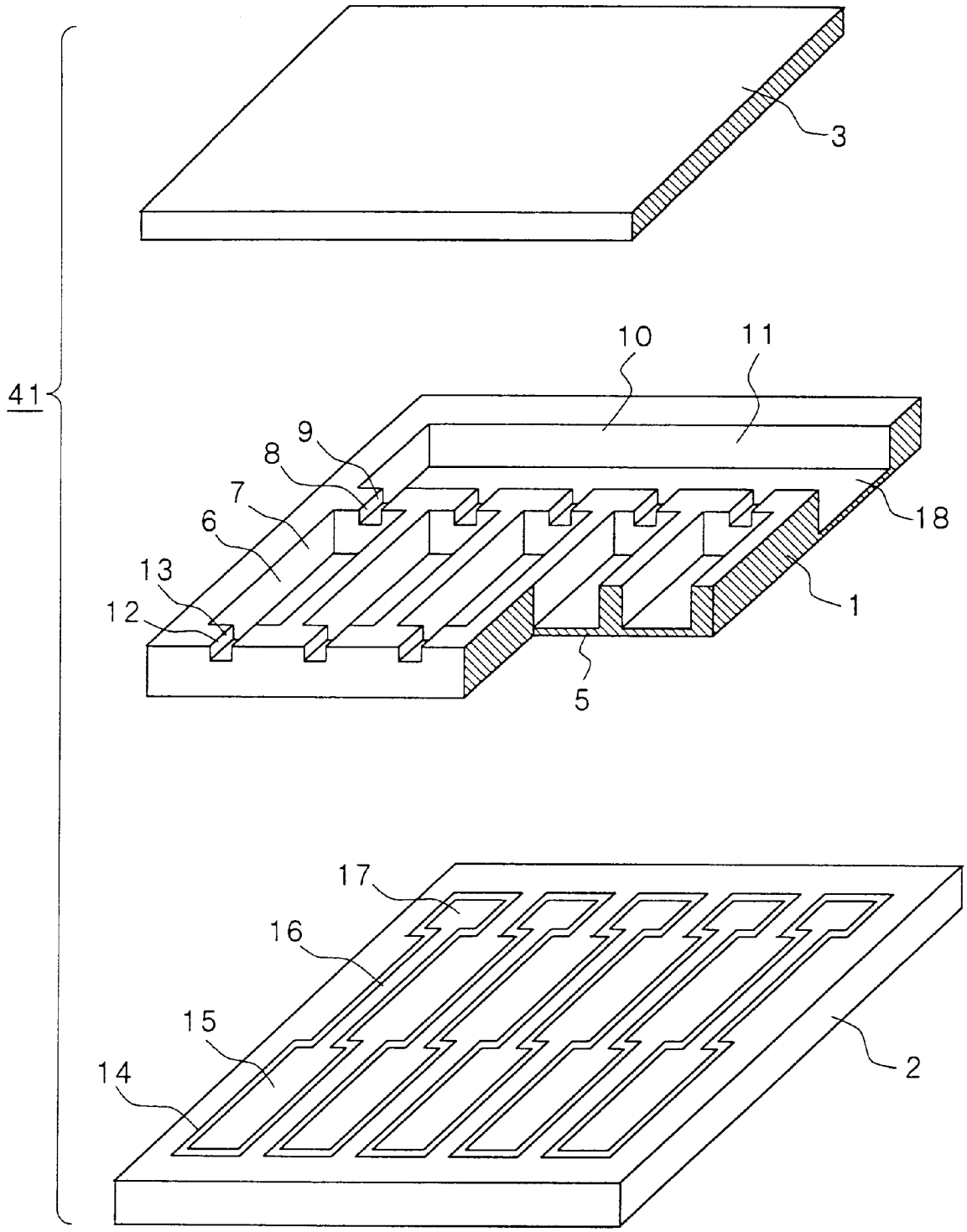
FIG. 1 is an exploded perspective view, showing in, partial section, a single-layer portion extracted from a stacked body of an ink jet head according to an embodiment 1 of the present invention.
Figure 2:
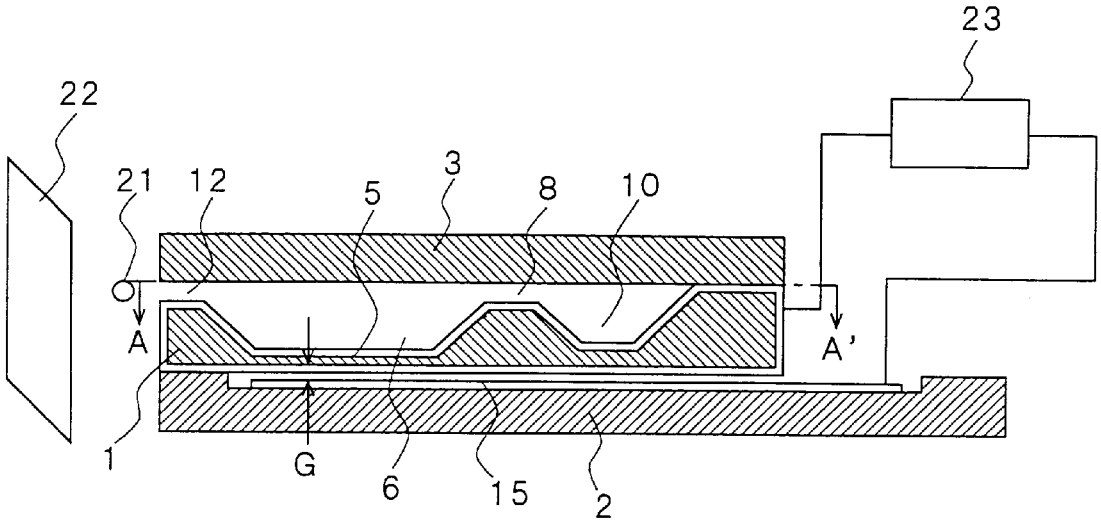
FIG. 2 is a sectional side view showing a state in which the single-layer portion in FIG. 1 is assembled.

Of a stacked body of an ink jet head according to this embodiment 1, a single-layer portion (hereinafter referred to as "ink jet head chip") has a configuration as shown in FIGS. 1 and 2. This ink jet head chip is an edge eject type ejecting ink drops from nozzle holes provided in a head end portion.

The ink jet head chip in this embodiment 1 has a stacked structure in which three substrates 1, 2 and 3 have been stacked one on another and bonded with each other, as shown in FIGS. 1 and 2. The first substrate 1 in the middle is constituted by an Si substrate having recess portions 7 constituting ejection chambers 6 with their bottom wall acting as a diaphragm 5, narrow grooves 9 for ink inlets provided at the rear of the recess portions 7 so as to constitute orifices 8, and a recess portion 11 constituting a common ink cavity 10 for feeding ink to the respective ejection chambers 6. In addition, narrow grooves 13 constituting nozzle holes 12 are provided on the side opposite to the narrow grooves 9 for ink inlets of the ejection chambers 6. An oxidized film 0.1 micron thick is formed all over the surface of the first substrate 1 by thermal oxidation, and this film is made to serve as an insulating film. This insulating film is for preventing insulation breakdown or short circuit at the time of ink jet driving.

Figure 3:
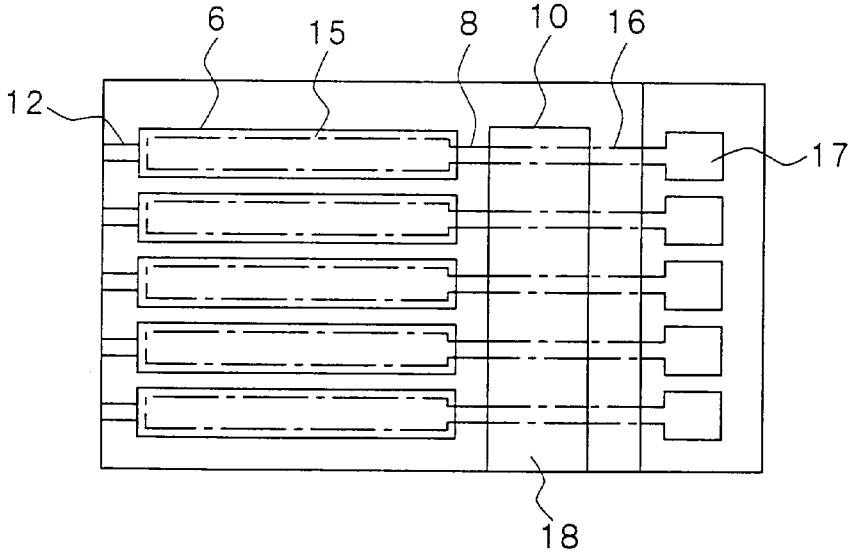
FIG. 3 is a view seen in the direction of arrow A–A' in FIG. 2.

As the second substrate 2 bonded with the lower surface of the first substrate 1, a borosilicate glass is used. Recess portions 14 for mounting electrodes 15 are etched by 0.3 micron in this second substrate 2 so as to form an opposite interval between the diaphragm 5 and each of the electrodes 15 disposed in opposition to the diaphragm 5, that is, a gap G, as shown in FIG. 2. Each of these recess portions 14 is patterned into a shape similar to and a little larger than the electrode portion shape, so that the electrode 15, a lead portion 16 and a terminal 17 as shown in FIG. 3 can be mounted therein. The electrode 15 is produced by 0.1 micron sputtering ITO in the recess portion 14 so as to form an ITO pattern. Therefore, the gap G is 0.2 micron after the anode bonding between the first substrate 1 and the second substrate 2 in this embodiment 1.

In addition, as the third substrate 3, which is bonded with the upper surface of the first substrate, an Si substrate or a borosilicate glass is used.

Next, the operation of the ink jet head chip configured thus will be described. As shown in FIG. 2, a pulse voltage of 0 V to 35 V is applied to the electrode 15 by a transmission circuit 23. When the surface of the electrode 15 is thereby electrified to a positive potential, the lower surface of the diaphragm 5 corresponding to the electrode 15 is electrified to a negative potential. Therefore, the diaphragm 5 is bent downward by the attraction action of static electricity. When the pulse voltage to the electrode 15 is next turned OFF, the diaphragm 5 is restored. Therefore, the pressure in the ejection chamber 6 rises suddenly, so as to eject an ink drop 21 toward recording paper 22 from the nozzle hole 12. Next, the diaphragm 5 is bent downward again, so that ink is supplied into the ejection chamber 6 from the ink cavity 10 through the orifice 8. Then, the connection between the substrate 1 and the transmission circuit 23 is performed through a window (not-shown) of the oxidized film opened in a portion of the substrate 1 by dry etching. In addition, feeding ink to the ink jet head is performed through an ink feed port 18 in an end portion of the ink cavity 10.

Figure 4:
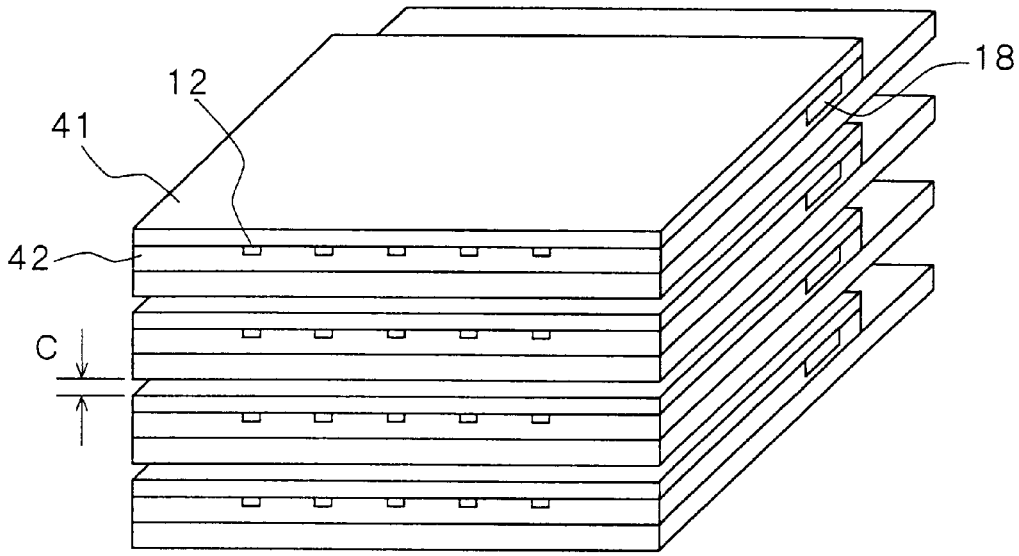
FIG. 4 is a perspective view of the stacked body of the ink jet head according to the embodiment 1 of the present invention.

The ink jet head according to this embodiment 1 is constituted by a stacked body in which four ink jet head chips 41 in FIGS. 1 to 3 have been stacked one on another, as shown in the perspective view of FIG. 4.

When the respective ink jet head chips 41 are put on top of each other simply, the scattering in thickness of the glasses reaches tens of microns, thereby causing scattering in nozzle lines. Further, when a bonding agent is used for bonding, it is difficult to control the thickness of a bonding layer, so that the scattering in the nozzle lines becomes larger. Therefore, the ink jet head chips 41 are stacked one on another in the state where they are separated from each other at intervals C, as shown in FIG. 4. First, the respective ink jet head chips 41 are set in an alignment jig which can move minutely in three directions X, Y and Z. The ink jet head chips 41 are aligned in the state where nozzle surfaces 42 are brought into tight contact with the surface of a glass prepared for alignment while the positions of the nozzle holes 12 are observed through the glass. Then, a bonding agent is poured among the ink jet head chips 41 to thereby fix the chips 41. Alternatively, the ink jet head chips 41 are put one on another in the state where they have been coated in advance with a UV-curing bonding agent or a thermosetting bonding agent, and UV radiation, heating or the like is performed to cure the bonding agent when the alignment is completed. An ink jet head constituted by a stacked body in which the ink jet head chips 41 have been stacked one on another can be produced in the above-mentioned manner, so that a multi-nozzle ink jet head with a plurality of nozzle lines can be realized.

Embodiment 2

Figure 5:
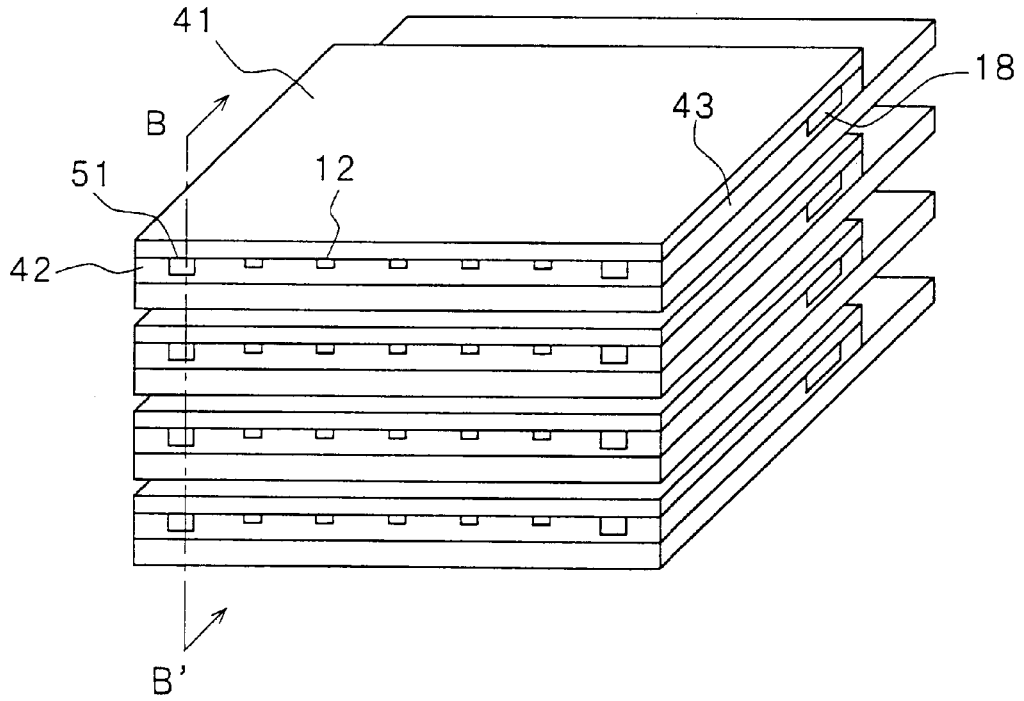
FIG. 5 is a perspective view of a stacked body of an ink jet head according to an embodiment 2 of the present invention.
Figure 6:
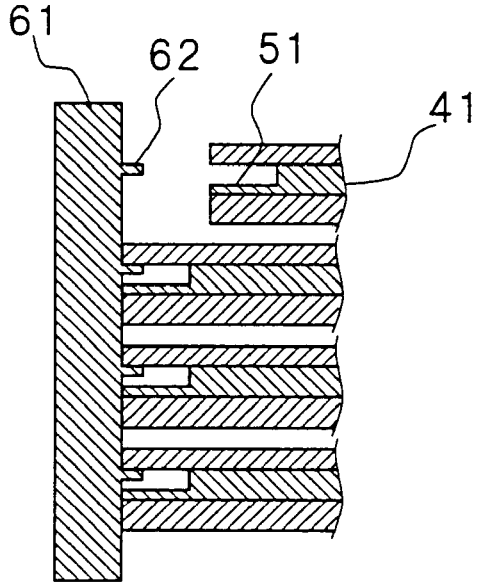
FIG. 6 is a sectional view taken on line B–B' in FIG. 5 at the time of alignment.
Figure 7:
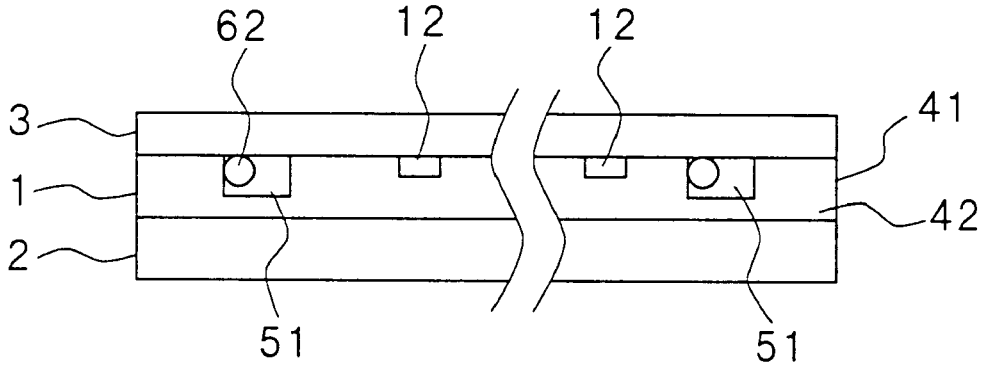
FIG. 7 is a side view illustrating a nozzle surface portion in FIG. 6.

In an ink jet head according to this embodiment 2, grooves 51 which will be guides at the time of alignment are provided in nozzle surfaces 42 of ink jet head chips 41, as shown in FIG. 5. This ink jet head in FIG. 5 is assembled while it is positioned by pins 62 of an alignment jig 61, as shown in FIGS. 6 and 7.

Figure 8:
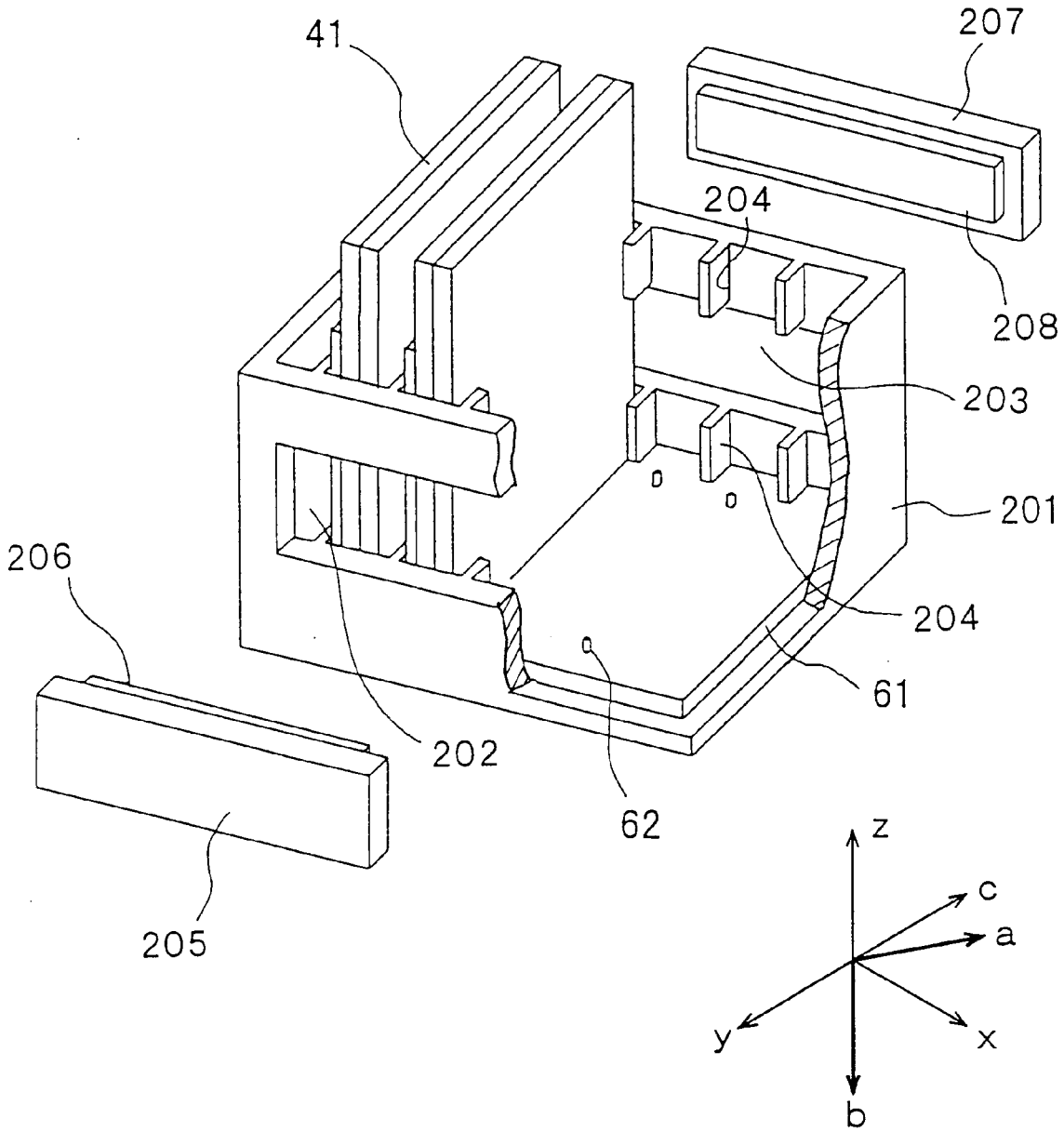
FIG. 8 is an exploded perspective view of an alignment device applied to the above embodiment 2.

The alignment jig 61 is included in an alignment device in FIG. 8 in advance. An alignment case 201 is opened in its upper portion, and provided with windows 202 and 203 in its side portion. Partition portions 204 shaped into projecting strips for determining the intervals of the ink jet head chips 41 are provided in the inner wall of the side portion. Clamping plates 205 and 206 are fitted into the windows 202 and 203. A porous rubber pad (hard) 206 is provided on the inner wall of one clamping plate 205, while a porous rubber pad (soft) 208 is provided on the inner wall of the other clamping plate 207. In addition, the alignment jig 61 is disposed on the bottom portion of the alignment case 201 so that the pins 62 look upward.

When the ink jet head chips 41 are positioned as shown in FIG. 5, the ink jet head chips 41 are inserted into among the partition portions 204 of the alignment case 201 in FIG. 8. The guide grooves 51 of the ink jet head chips 41 are fitted to the pins 62 of the alignment jig 61 as shown in FIG. 6. Then, the clamping plate 205 is fitted into the window 202 while the porous rubber pad (hard) 206 is pressed in the direction a of FIG. 8. On the other hand, the clamping plate 207 is fitted into the window 203 while the porous rubber pad (soft) 208 is pressed in the direction b of FIG. 8. When the ink jet head chips 41 are fixed in such a manner, the porous rubber pad (hard) 206 is shifted in the direction c of FIG. 8 because the porous rubber pad (hard) 206 is harder than the porous rubber pad (soft) 208. As a result, the ink jet head chips 41 are aligned in the positions shown in FIGS. 5 and 7. After that, a bonding agent is poured among the ink jet head chips 41 and cured. In such a manner, an ink jet head constituted by a stacked body in which the ink jet head chips 41 have been stacked one on another can be produced.

Embodiment 3

Figure 9:
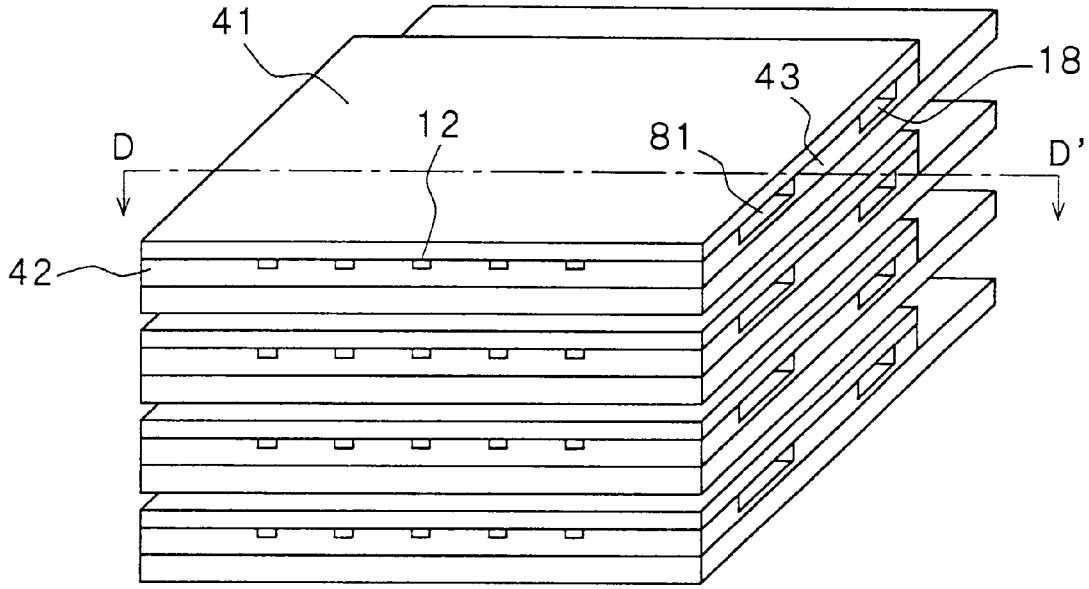
FIG. 9 is a perspective view of a stacked body of an ink jet head according to an embodiment 3 of the present invention.

In an ink jet head according to this embodiment 3, grooves 81 which will be guides at the time of alignment are provided in side surfaces 43 of ink jet head chips 41, as shown in FIG. 9. This ink jet head in FIG. 9 is assembled while it is positioned by alignment plates 92 of alignment jigs 91 shown in FIG. 10.

Figure 11:
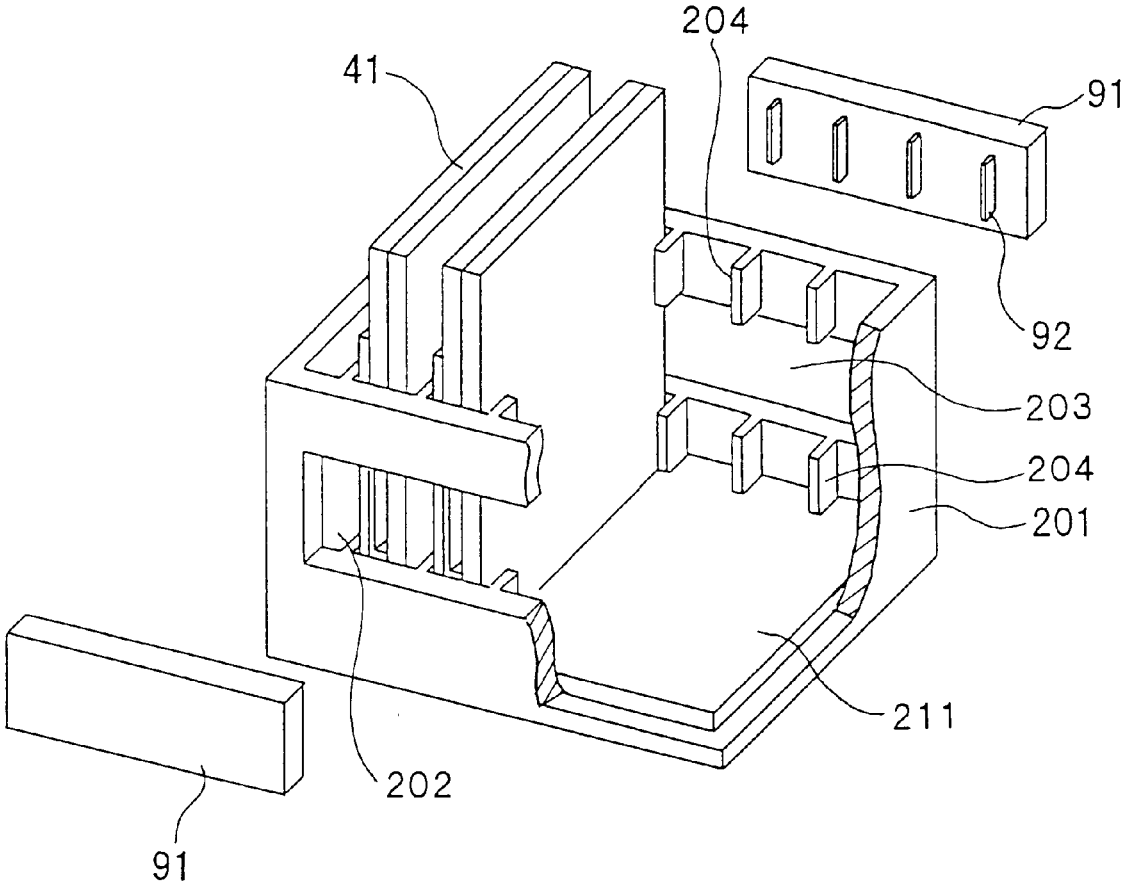
FIG. 11 is an exploded perspective view of an alignment device applied to the above embodiment 3.

The alignment jigs 91 are included in an alignment device in FIG. 11 in advance. An alignment case 201 is opened in its upper portion, and provided with windows 202 and 203 in its side portion. Partition portions 204 shaped into projecting strips for determining the intervals of the ink jet head chips 41 are provided in the inner wall of the side portion. The alignment jigs 91 are fitted into the windows 202 and 203. The alignment plates 92 are provided on the inner wall of each of these jigs 91. In addition, a smooth plate 211 for truing up the nozzle surfaces 42 is disposed on the bottom portion of the alignment case 201.

Figure 10:
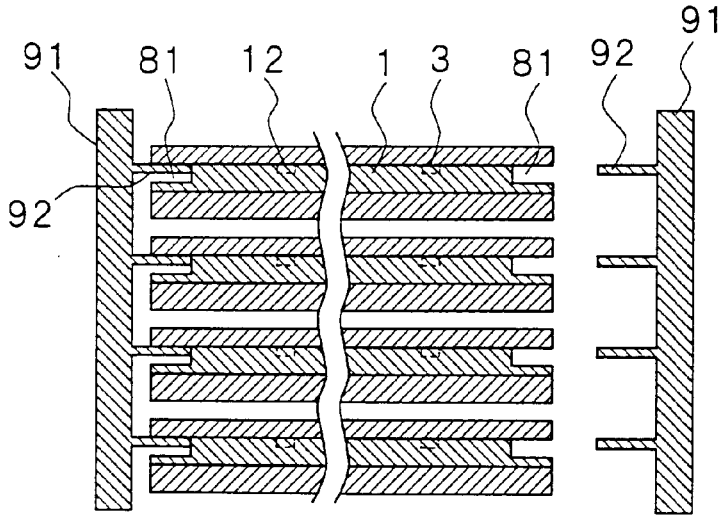
FIG. 10 is a sectional view taken on line D–D' in FIG. 9 at the time of alignment.

When the ink jet head chips 41 are positioned as shown in FIG. 9, the ink jet head chips 41 are inserted into among the partition portions 204 of the alignment case 201 in FIG. 11, and pressed onto the smooth plate 211 on the bottom portion of the alignment case 201, so as to adjust the positions of the nozzle surfaces 42. Next, the alignment plates 92 of the alignment jigs 91 are inserted into the guide grooves 81 in the side surfaces of the ink jet head chips 41 from opposite sides, as shown in FIG. 10. Then, the alignment jigs 91 are moved horizontally, so that the upper surfaces of the alignment plates 92 are fitted to the bonded surface between the substrate 1 in the guide grooves 81 and the glass substrate 3, so as to true up the intervals among the nozzle lines. After that, a bonding agent is poured among the ink jet head chips 41 and cured. In such a manner, an ink jet head constituted by a stacked body in which the ink jet head chips 41 have been stacked one on another can be produced.

Embodiment 4

Figure 13:
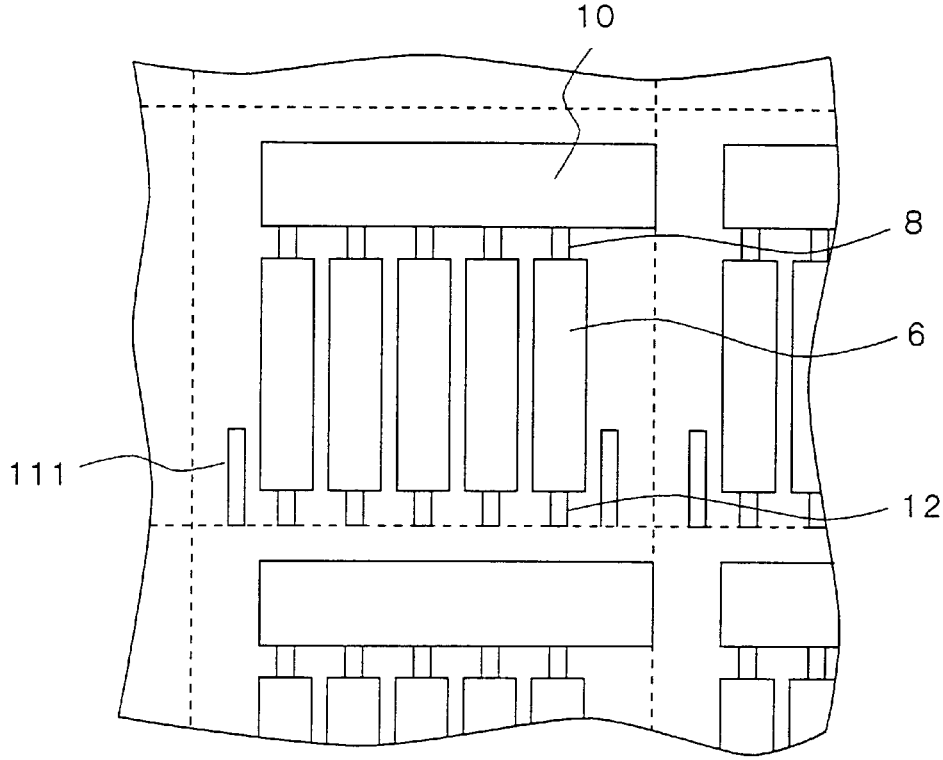
FIG. 13 is a top view of the first substrate in the case where a guide groove of the ink jet head in the above embodiment 2 has been formed in the nozzle surface.
Figure 14:
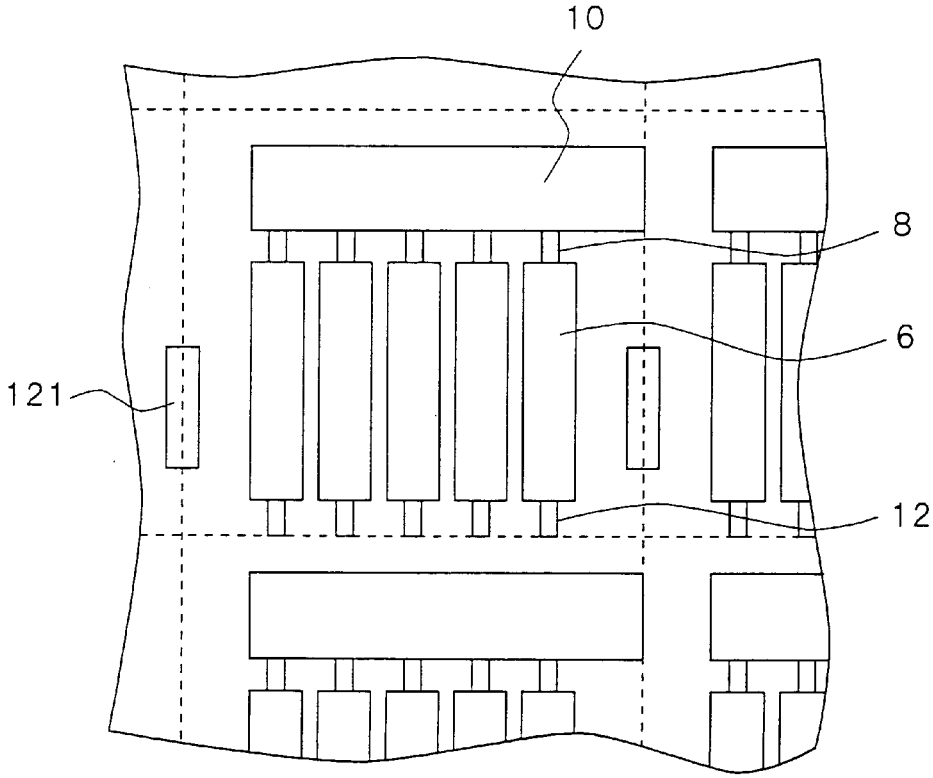
FIG. 14 is a top view of the first substrate in the case where a guide groove of the ink jet head in the above embodiment 3 has been formed in the side surface.

Next, a method of manufacturing the first substrate 1 including the guide grooves 51 or 81 in the above-mentioned embodiment 2 or 3 will be described with reference to FIGS. 12 to 14. The dotted lines in these drawings designate cut portions at the time of dicing.

Figure 12:
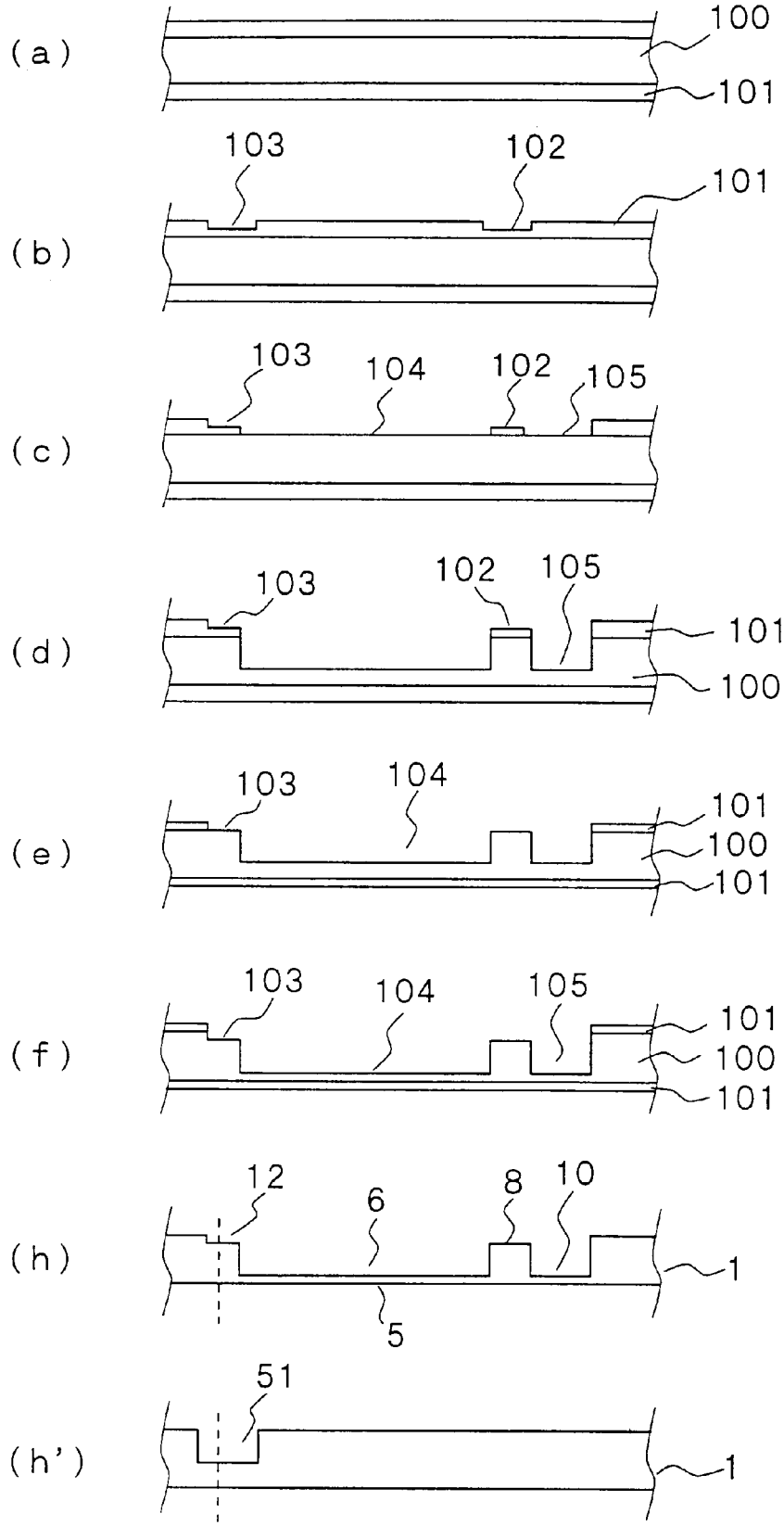
FIG. 12 is a view of etching steps which constitute manufacturing steps of a first substrate of the ink jet head in the above embodiment 2 or 3.

① An oxidized film 101 is formed all over the surface of an Si substrate 100 of a face orientation (110) to be 1.2 micron thick under the conditions that oxidization temperature is 1,100° C., and oxidization time is four hours (FIG. 12(*a*)).

② The oxidized film 101 in a portion 102 which will be an orifice 8 (FIG. 13 or 14) and a portion 103 which will be a nozzle hole 12 (FIG. 13 or 14) is etched to be 0.2 micron thick in a photo-lithography process (FIG. 12(*b*)).

③ Next, a portion 104 which will be an ejection chamber 6 (FIG. 13 or 14) and a portion 105 which will be an ink cavity 10 (FIG. 13 or 14) are eliminated by fluoric acid water-solution in a photo-lithography process (FIG. 12(*c*)). At the same time, the oxidized film 101 in a portion 111 (FIG. 13) which will be a guide groove 51 (FIG. 5) is eliminated by the fluoric acid water-solution when the guide groove 51 (FIG. 5) is provided in the nozzle surface 42. On the other hand, the oxidized film 101 in a portion 121 (FIG. 14) which will be a guide groove 81 (FIG. 9) is eliminated by the fluoric acid water-solution when the guide groove 81 (FIG. 9) is provided in the side surface 43.

④ Upon completion of patterning of the oxidized film 101, the Si substrate 100 in the portion 104 which will be an ejection chamber 6 (FIG. 13 or 14), the portion 105 which will be an ink cavity 10 (FIG. 13 or 14), and the portion 111 (FIG. 13) or 121 (FIG. 14) which will be a guide groove 51 (FIG. 5) or 81 FIG. 9) is etched with potassium hydrate water-solution by the size in which the thickness of a diaphragm or the depth of a narrow groove has been excluded from the thickness of the substrate (FIG. 12(*d*)).

⑤ Next, the Si substrate 100 is immersed into fluoric acid water-solution. With the etching time adjusted properly, only the oxidized film in the portion 102 which will be an orifice 8 (FIG. 13 or 14) and the portion 103 which will be a nozzle hole 12 (FIG. 13 or 14) is eliminated (FIG. 12(*e*)).

⑥ The Si substrate 100 in the portion 104 which will be an ejection chamber 6 (FIG. 13 or 14), the portion 105 which will be an ink cavity 10 (FIG. 13 or 14), the portion 111 (FIG. 13) or 121 (FIG. 14) which will be a guide groove 51 (FIG. 5) or 81 (FIG. 9), the portion 102 which will be an orifice 8 (FIG. 13 or 14), and the portion 103 which will be a nozzle hole 12 (FIG. 13 or 14) is etched with potassium hydrate water-solution again (FIG. 12(*f*)).

⑦ Last, the oxidized film 101 left on the surface of the Si substrate 100 is eliminated completely with fluoric acid water-solution (FIG. 12(*h*)). The sectional shape of a portion corresponding to the guide groove 51 at this time is as shown FIG. 12(*h*'). FIGS. 12(*d*) to (*h*) show the sectional shape of a portion corresponding to a nozzle hole. The sectional shape of a portion corresponding to the guide groove 51 or 81 is not illustrated.

As mentioned above, the guide grooves 51 (FIG. 5) or 81 (FIG. 9) are also patterned in a photo-lithography process, and formed by anisotropic etching with potassium hydrate water-solution with high accuracy in their positions. Accordingly, the shape accuracy of the guide grooves 51 (FIG. 5) or 81 (FIG. 9) is also high.

Therefore, the displacement between the nozzle holes 12 (FIG. 5 or 9) and the guide grooves 51 (FIG. 5) or 81 (FIG. 9) can be suppressed to be several microns. Accordingly, it is possible to align ink jet head chips using the guide grooves 51 (FIG. 5) or 81 (FIG. 9). In addition, it is possible to avoid the influence of a change in the outside dimensions of the ink jet head chips 41 (FIG. 4) due to dicing accuracy with the guide grooves 51 (FIG. 5) or 81 (FIG. 9) as a reference in the alignment. The etching may be based on anisotropic dry etching in the same manner as the case of anisotropic etching with potassium hydrate water-solution.

Embodiment 5

In an ink jet head according to this embodiment 5, a nozzle plate is bonded with the stacked body of the ink jet head in FIG. 4, 5 or 9.

Figure 15:
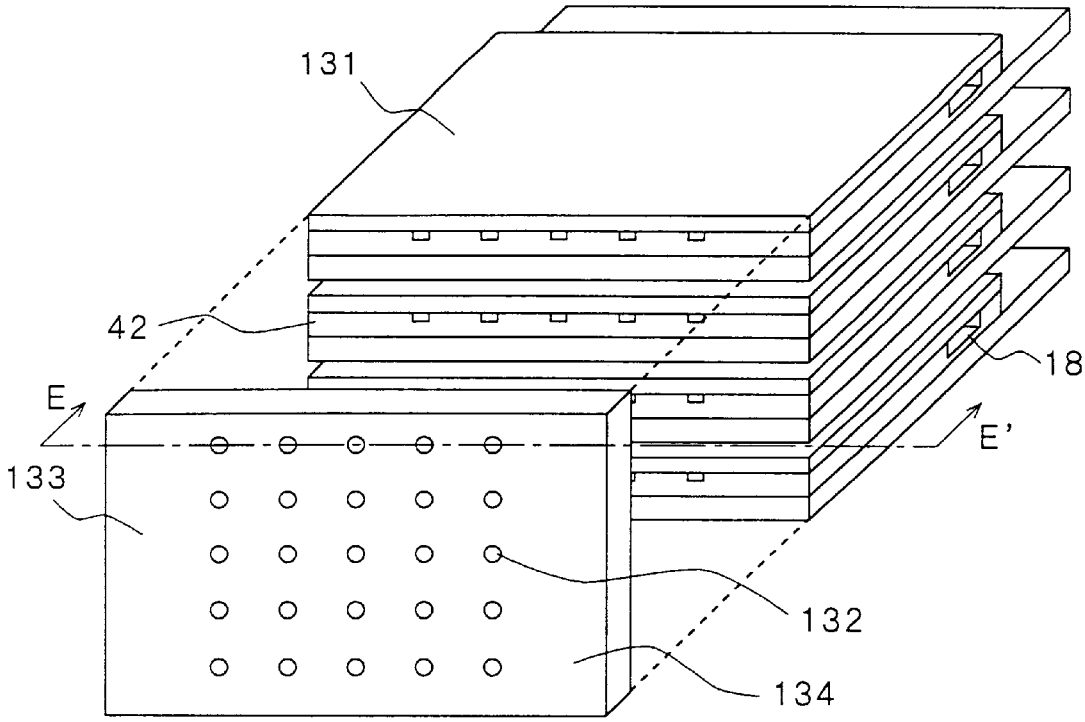
FIG. 15 is an exploded perspective view of a stacked body of an ink jet head according to an embodiment 5 of the present invention.
Figure 16:
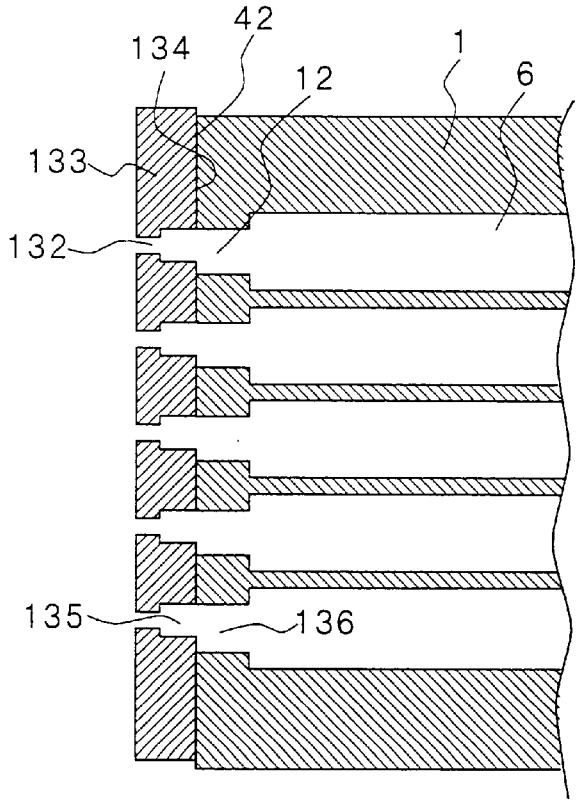
FIG. 16 is a sectional view taken on line E–E' in FIG. 15.

As shown in FIG. 15, a stacked body 131 of the ink jet head is constituted by the stacked body (FIG. 4, 5 or 9) in which four ink jet head chips 41 are stacked one on another, and a nozzle plate 133 having a number of nozzle holes 132 formed in an Si substrate is bonded on the nozzle surface 42. The opening area of each aperture portion 135 of the nozzle holes 132 on the side of a bonded surface 134 of the nozzle plate 133 is made smaller than the opening area of each aperture portion 136 of nozzle holes 12 of the ink jet head stacked body 131, as shown in FIG. 16. Therefore, it will do if the aperture portions 135 of the nozzle holes 132 are received within the aperture portions 136 of the nozzle holes 12 of the ink jet head stacked body 131, and it is not necessary to perform high-degree alignment upon the stacked body 131 of the ink jet head. In addition, the nozzle holes 132 on the nozzle plate 133 are formed in a lump in a photo-lithography process. Accordingly, the position accuracy of the nozzle holes 132 is extremely high to be within several microns.

On the other hand, since the ejection characteristic of an ink jet head is affected by a change of flow path resistance caused by the length of nozzle holes, it is necessary, in the above-mentioned simply stacked ink jet head, to adjust the length of the nozzle holes 12 by grinding the nozzle surface 42 after dicing, etc. However, in the ink jet head in this embodiment 5, the length of the nozzle holes 132 of the nozzle plate 133 has an influence on the ejection characteristic of ink. Therefore, by enlarging the opening area of the nozzle holes 12 to reduce the influence of the length, it is made unnecessary to adjust the length of the ink nozzle holes 12.

Next, a method of manufacturing the nozzle plate 133 in this embodiment 5 will be described on the basis of the process diagram of FIG. 17.

Figure 17:
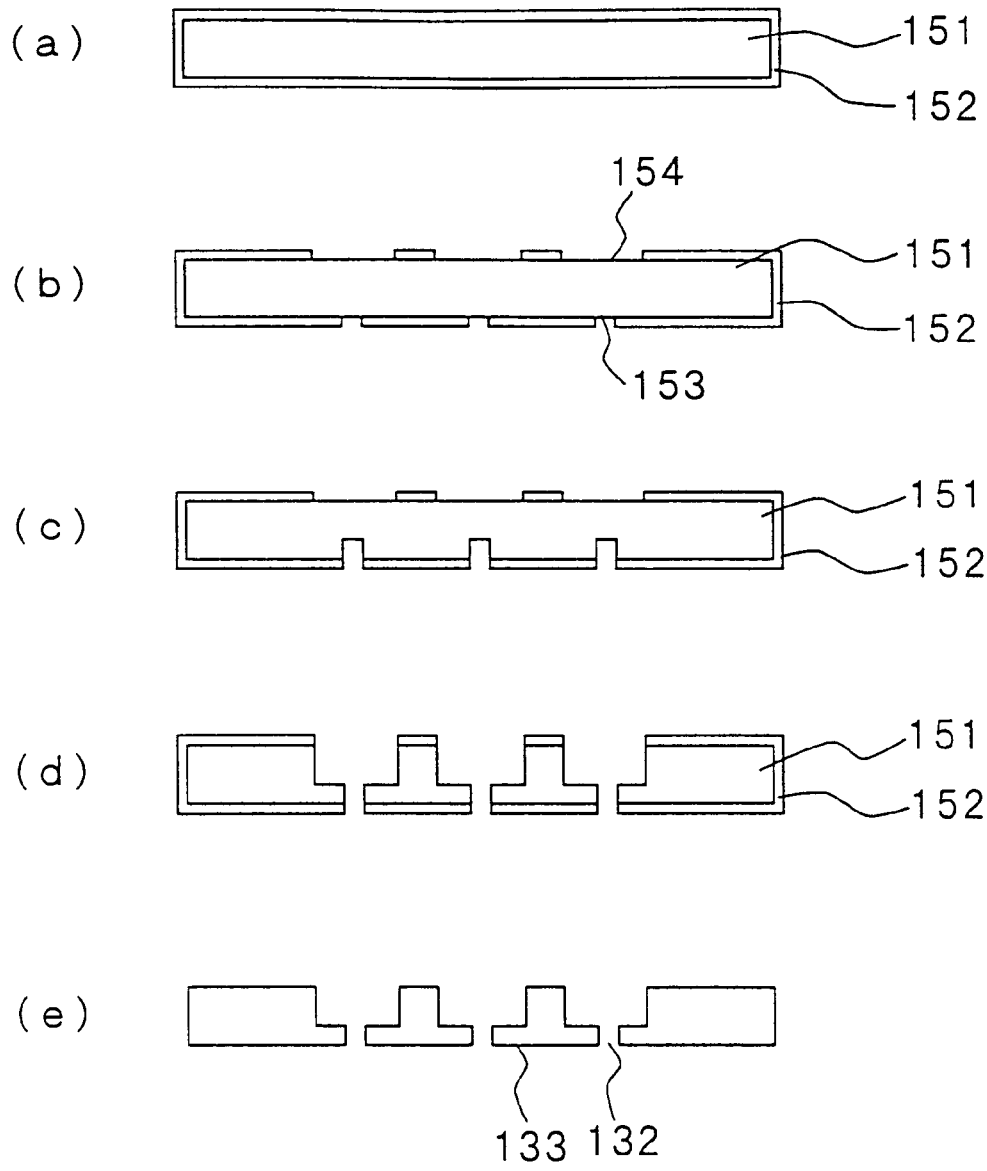
FIG. 17 is a view of etching steps which constitute manufacturing steps of a nozzle plate of the ink jet head in the above embodiment 5.

① An oxidized film 152 is formed all over the surface of an Si substrate 151, which is 180 microns thick, to a 1.2 micron thickness under the conditions that oxidization temperature is 1,100° C., and oxidization time is four hours (FIG. 17(*a*)).

② The oxidized film in portions 153 which will be nozzle holes on the ink ejection surface side and portions 154 which will be nozzle holes on the bonded surface side is eliminated with fluoric acid water-solution in a photo-lithography process (FIG. 17(*b*)).

③ The Si substrate 151 is etched from the portions 153, which will be nozzle holes on the ink ejection surface side, to a depth of 35 microns by means of dry etching (FIG. 17(*c*)). Further, the Si substrate 151 is etched from the portions 154, which will be nozzle holes on the bonded surface side opposite to the ink ejection surface, to a depth of 150 microns by means of dry etching (FIG. 17(*d*)). At this time, the length of the nozzle holes 132 is 30 microns.

④ When all etching of the Si substrate 151 is completed, the oxidized film 152 left on the surface of the Si substrate 151 is eliminated with fluoric acid water-solution (FIG. 17(*e*)).

In the above-mentioned process, it is possible to manufacture the nozzle plate 133 in which the position accuracy of nozzle holes is high and the length of the nozzle holes is stable.

Embodiment 6

In an ink jet head according to this embodiment 6, guide protrusions are formed on the above-mentioned nozzle plate 133, while guide grooves corresponding to the guide protrusions are provided in the ink jet head chips 41.

Figure 18:
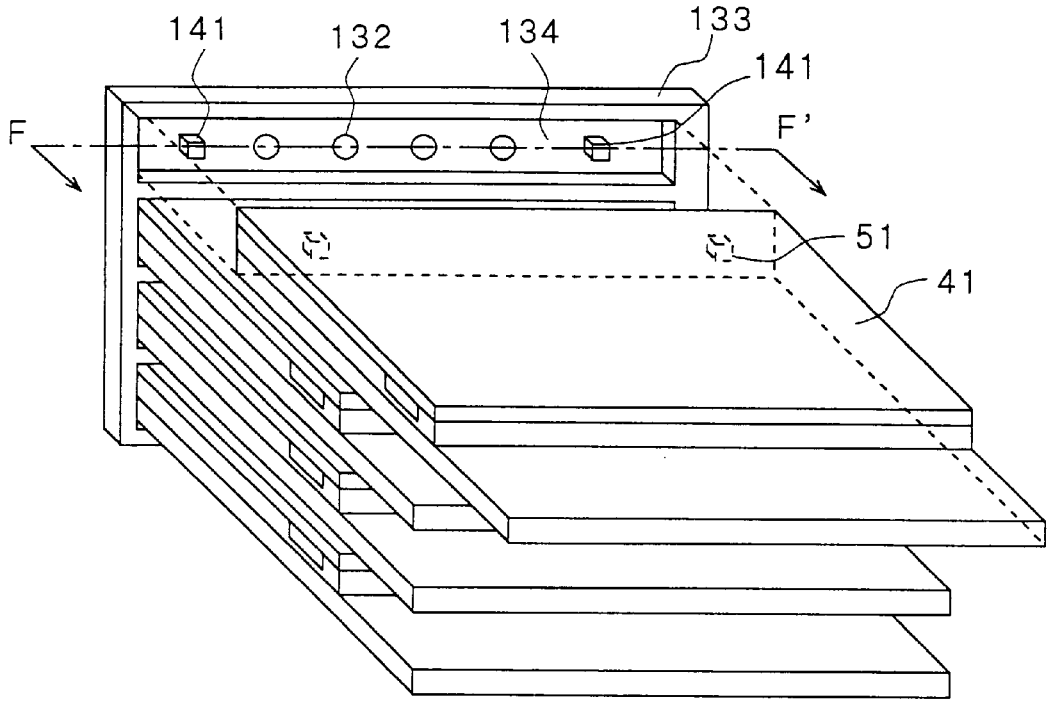
FIG. 18 is an exploded perspective view of a stacked body of an ink jet head according to an embodiment 6 of the present invention.
Figure 19:
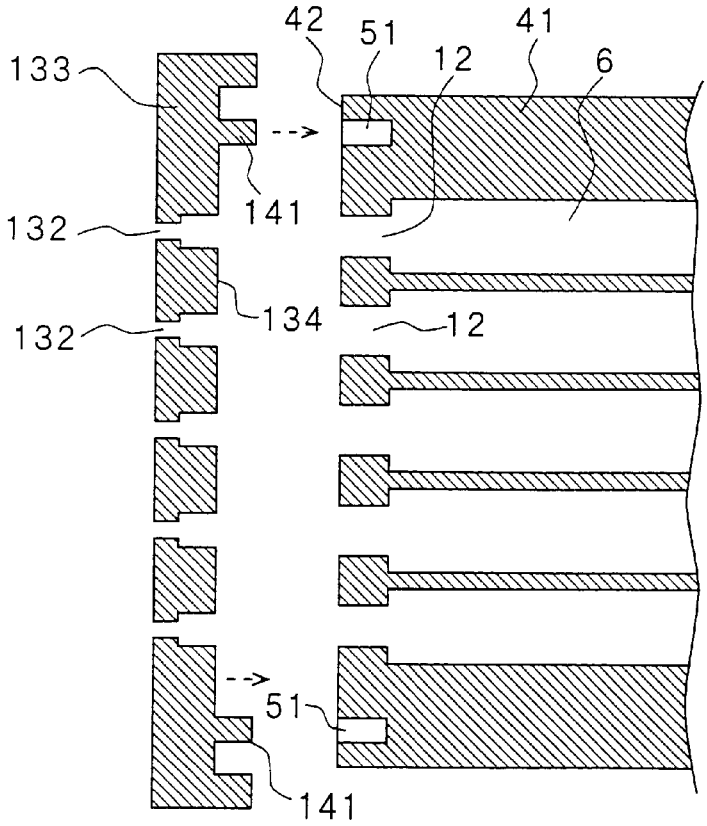
FIG. 19 is a sectional view taken on line F–F' in FIG. 18.

As shown in FIG. 18, in the nozzle plate 133, guide protrusions 141 for aligning the ink jet head chips 41 are formed on the bonded surface 134 on which the ink jet head chips are bonded. The ink jet head chips 41 are aligned by inserting these guide protrusions 141 into guide grooves 51 formed in nozzle surfaces 42 of the ink jet head chips 41, as shown in FIG. 19. Then, the nozzle plate 133 and the respective ink jet head chips 41 are bonded by a bonding agent. By giving a function as alignment jig to the nozzle plate 133, it is possible to simplify the production of an alignment jig, and it is made easy to manufacture the stacked body 131 of the ink jet head.

Next, an example of manufacturing the nozzle plate 133 in this embodiment 6 will be explained on the basis of the process diagram of FIG. 20.

Figure 20:
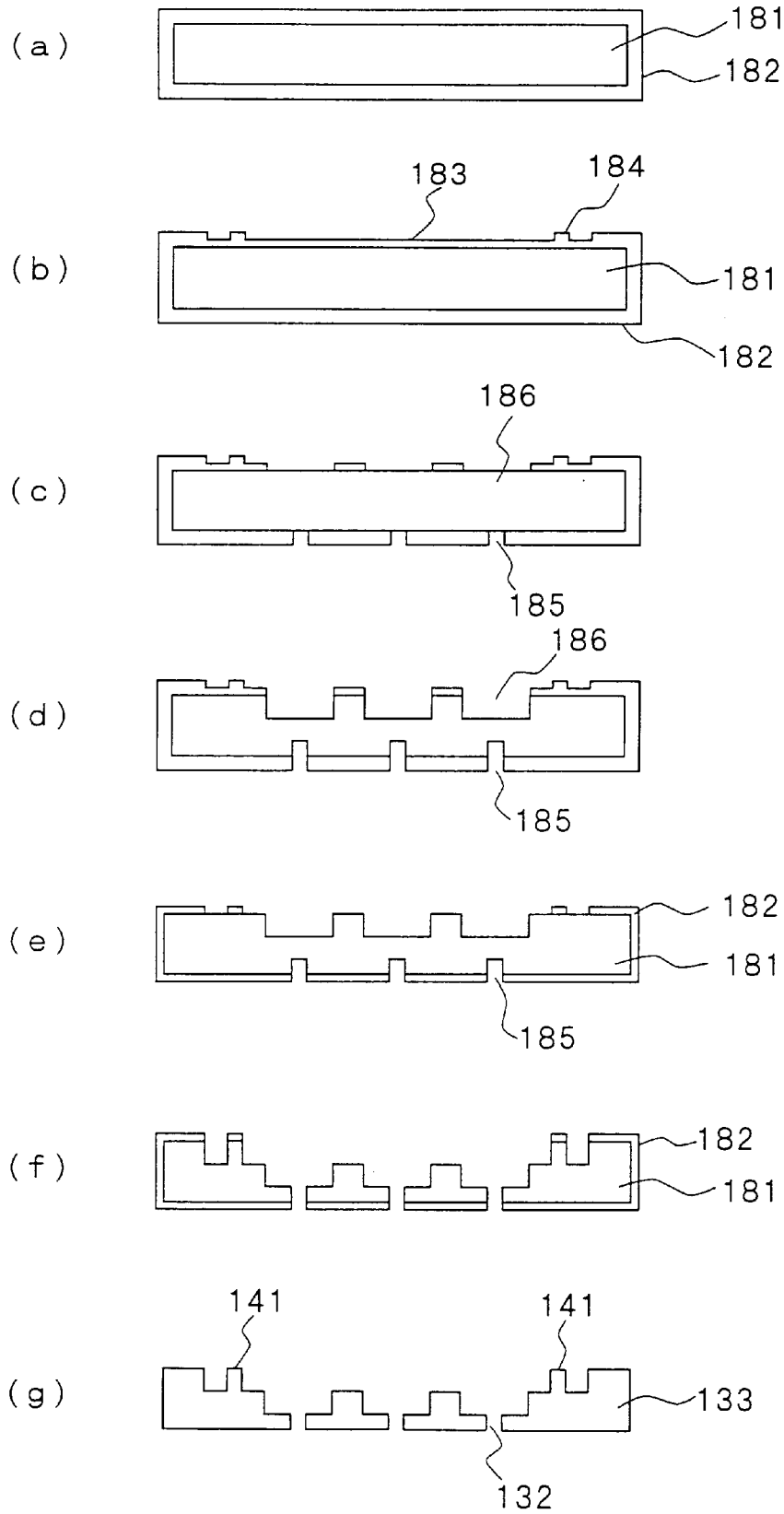
FIG. 20 is a view of etching steps which constitute manufacturing steps of a nozzle plate of the ink jet head according to the above embodiment 6.

① An oxidized film 182 which is 1.2 microns thick is formed by thermal oxidation all over the surface of an Si substrate 181, which is 280 microns thick, under the conditions that oxidization temperature is 1,100° C., and oxidization time is four hours (FIG. 20(*a*)).

② The oxidized film in a portion 183 which will be a bonded surface 134 with the ink jet head chips 41 is half-etched in a photo-lithography process and an etching process with fluoric acid water-solution (FIG. 20(*b*)). Portions 184 like islands left in the right and left of the substrate are the portions which will be guide protrusions 141.

③ Next, in the same manner as the nozzle plate in the above-mentioned embodiment 5, the oxidized film 182 in portions 185 which will be nozzle holes on the ejection surface side and portions 186 which will be nozzle holes on the bonded surface side is eliminated with fluoric acid water-solution in a photo-lithography process (FIG. 20(*c*)). The Si substrate 181 is etched from the portions 185, which will be nozzle holes on the ink ejection surface side, to a depth of 35 microns by means of dry etching (FIG. 20(*d*)). Further, the Si substrate 181 is etched from the portions 186, which will be nozzle holes on the bonded surface side, to a depth of 50 microns by means of dry etching (FIG. 20(*e*)).

④ Next, only the oxidized film in the portion 183 which will be a bonded surface 134 is eliminated with fluoric acid water-solution while the etching time is adjusted. The Si substrate 181 in the portion 183 which will be a bonded surface 134 and the portions 186 which will be nozzle holes on the bonded surface side is etched to a depth of 200 microns by means of dry etching from the bonded surface side (FIG. 20(*f*)). At this time, the length of the nozzle holes 132 is 30 microns.

⑤ When all etching of the Si substrate 181 is completed, the oxidized film 182 left on the surface of the Si substrate 181 is eliminated with fluoric acid water-solution (FIG. 20(*g*)).

Since the guide protrusions 141 are also formed in a photo-lithography process and an etching process as mentioned above, it is possible to manufacture the guide protrusions 141 with respect to the nozzle holes 132 with high accuracy.

Embodiment 7

Figure 21:
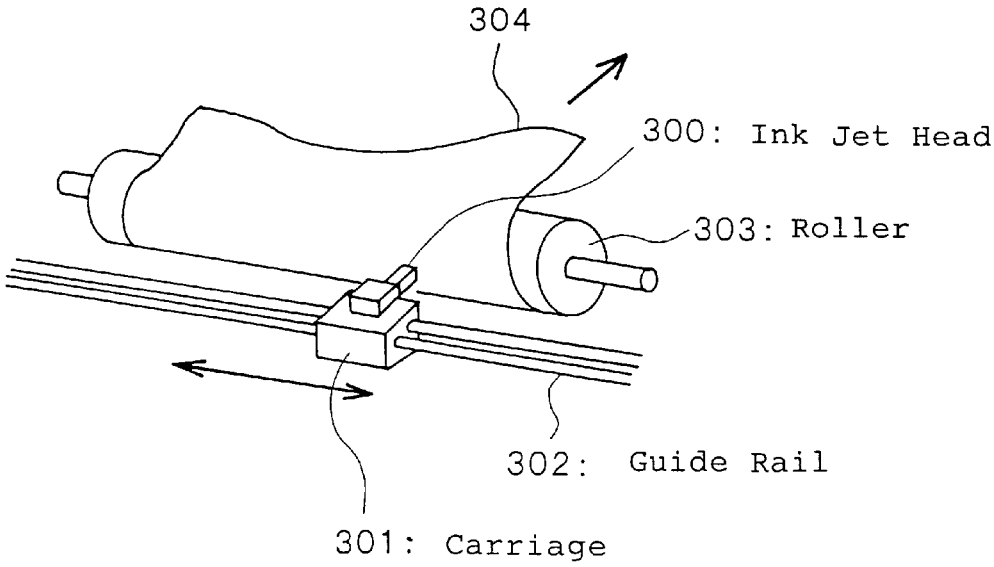
FIG. 21 is an explanatory view illustrating a mechanism around the ink jet head in FIG. 4, 5, 9, 15 or 18.
Figure 22:
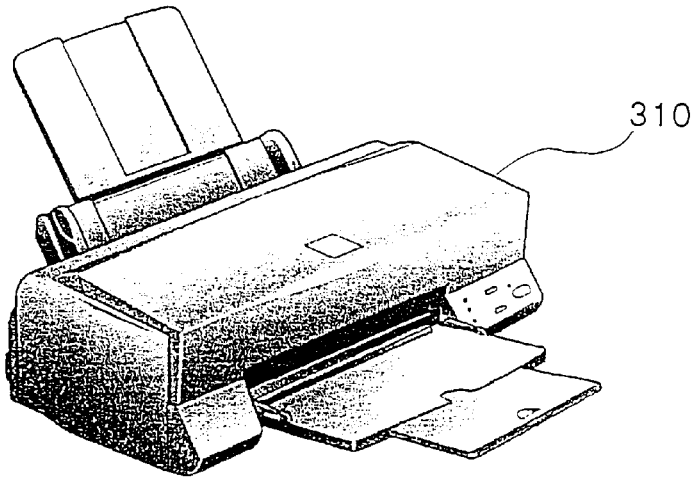
FIG. 22 is an outside view of an ink jet recording apparatus including the mechanism shown in FIG. 21.

An ink jet head 300 shown in FIG. 4, 5, 9, 15 or 18 is attached to a carriage 301 as shown in FIG. 21. This carriage 301 is attached to a guide rail 302 movably, and its position is controlled in the widthwise direction of paper 304 fed out by a roller 303. This mechanism in FIG. 21 is mounted on an ink jet recording apparatus 310 shown in FIG. 22.

What is claimed is:

1. An ink jet head comprising:

a stacked body having a plurality of ink jet head chips stacked one on another at predetermined intervals, wherein each of said ink jet head chips comprises:

a plurality of nozzle holes for ejecting ink drops;

a plurality of ejection chambers connected to said plurality of nozzle holes, respectively;

a plurality of diaphragms each constituting at least one wall of each of said ejection chambers, respectively; and a plurality of driving means for producing transformation in said diaphragms, respectively; and wherein each of said ink jet head chips further comprises a plurality of grooves that are formed in a front end surface on a nozzle hole side or in an opposite side end surface thereof, and act as guides during stacking to substantially align said plurality of ink jet head chips with each other in said stacked body; and wherein each of said ink jet head chips comprises an upper substrate, a middle substrate, and a lower substrate, and said plurality of grooves are formed in said middle substrate.

2. An ink jet recording apparatus comprising:

an ink jet head comprising:

a stacked body having a plurality of ink jet head chips stacked one on another at predetermined intervals, wherein each of said plurality of ink jet head chips comprises:

a plurality of nozzle holes for ejecting ink drops;

a plurality of ejection chambers connected to said plurality of nozzle holes, respectively;

a plurality of diaphragms each constituting at least one wall of each of said ejection chambers, respectively; and a plurality of driving means for producing transformation in said diaphragms, respectively; and wherein each of said ink jet head chips further comprises a plurality of grooves for acting as guides upon stacking of said plurality of ink jet head chips, and said grooves are formed in an end surface on a nozzle hole side, or in an opposite side surface, of each of said plurality of ink jet head chips, and wherein said guide grooves of each ink jet head chip are substantially aligned with corresponding guide grooves of each other ink jet head chip in said stacked body; and wherein each of said ink jet head chips comprises an upper substrate, a middle substrate, and a lower substrate, and said plurality of grooves are formed in said middle substrate.

3. An ink jet recording apparatus comprising:

an ink jet head comprising:

a stacked body having a plurality of ink jet head chips stacked one on another at predetermined intervals; and a nozzle plate bonded with said stacked body; and wherein each of said ink jet head chips comprises:

a plurality of aperture portions for allowing ink drops to flow therethrough;

a plurality of ejection chambers connected to said plurality of aperture portions, respectively;

a plurality of diaphragms each constituting at least one wall of each of said ejection chambers; and a plurality of driving means for producing transformation in said diaphragms, respectively; and wherein said nozzle plate has a plurality of nozzle holes for ejecting the ink drops received from said aperture portions; and wherein each of said ink jet head chips further comprises a plurality of grooves for acting as guides upon stacking of said plurality of ink jet head chips, and said grooves are formed in an end surface on a nozzle hole side, or in an opposite side surface, of each of said plurality of ink jet head chips, and wherein said guide grooves of each ink jet head chip are substantially aligned with corresponding guide grooves of each other ink jet head chip in said stacked body; and wherein each of said ink jet head chips comprises an upper substrate, a middle substrate, and a lower substrate, and said plurality of grooves are formed in said middle substrate.

4. An ink jet head manufacturing method for manufacturing an ink jet head which comprises:

a stacked body having a plurality of ink jet head chips stacked one on another at predetermined intervals, each of said ink jet head chips comprising:

a plurality of nozzle holes for ejecting ink drops;

a plurality of ejection chambers connected to said plurality of nozzle holes respectively;

a plurality of diaphragms each constituting at least one wall of each of said ejection chambers respectively; and a plurality of driving means for producing transformation in said diaphragms, respectively; and wherein said method comprises the steps of:

forming a plurality of grooves, for acting as guides upon stacking said plurality of ink jet head chips, by anisotropic etching in an end surface on a nozzle side of each of said plurality of ink jet head chips;

preparing an alignment case, which is opened in its upper portion, and which is provided in the inner wall of its side portion with partition portions shaped in projecting strips for determining the intervals of the ink jet head chips, and including an alignment jig having pins, which is disposed the bottom of said alignment case so that the pins extend upward; and aligning said plurality of ink jet head chips by inserting the ink jet head chips between said partition portions of the alignment case and inserting said pins of the alignment jig into said plurality of grooves.

5. An ink jet head manufacturing method according to claim 4, wherein said alignment case is further provided in its side portions with a pair of windows, and the method further comprises inserting into said pair of windows clamping plates having rubber pads for aligning said plurality of ink jet head chips.

6. An ink jet head manufacturing method for manufacturing an ink jet head which comprises:

a stacked body having a plurality of ink jet head chips stacked one on another at predetermined intervals;

each of said ink jet head chips comprising:

a plurality of nozzle holes for ejecting ink drops;

a plurality of ejection chambers connected to said plurality of nozzle holes, respectively;

a plurality of diaphragms each constituting at least one wall of each of said ejection chambers, respectively; and a plurality of driving means for producing transformation in said diaphragms, respectively; and wherein said method comprises the steps of:

forming a plurality of grooves, for acting as guides upon stacking said plurality of ink jet head chips, by anisotropic etching in each of opposite side surfaces of each of said plurality of ink jet head chips;

preparing an alignment case, which is opened in its upper portion, and which is provided in the inner wall of its side portion with partition portions shaped in projecting strips for determining the intervals of the ink jet head chips, and which is provided in its side portion with a pair of windows;

fitting alignment jigs, each provided on its inside wall with alignment plates, into said windows; and aligning said plurality of ink jet head chips by inserting said alignment plates into said plurality of grooves.

7. An ink jet head comprising:

a stacked body having a plurality of ink jet head chips stacked one on another at predetermined intervals, wherein each of said ink jet head chips comprises:

a plurality of nozzle holes for ejecting ink drops;

a plurality of ejection chambers connected to said plurality of nozzle holes, respectively;

a plurality of diaphragms each constituting at least one wall of each of said ejection chambers, respectively; and a plurality of drivers that produce transformation in said diaphragms, respectively; and wherein each of said ink jet head chips further comprises a plurality of grooves that are formed in a front end surface on a nozzle hole side or in an opposite side end surface thereof, and act as guides during stacking to substantially align said plurality of ink jet head chips with each other in said stacked body; and wherein each of said ink jet head chips comprises an upper substrate, a middle substrate, and a lower substrate, and said plurality of grooves are formed in said middle substrate.

8. An ink jet recording apparatus comprising:

an ink jet head comprising:

a stacked body having a plurality of ink jet head chips stacked one on another at predetermined intervals, wherein each of said plurality of ink jet head chips comprises:

a plurality of nozzle holes for ejecting ink drops;

a plurality of ejection chambers connected to said plurality of nozzle holes, respectively;

a plurality of diaphragms each constituting at least one wall of each of said ejection chambers, respectively; and a plurality of drivers that produce transformation in said diaphragms, respectively; and wherein each of said ink jet head chips further comprises a plurality of grooves for acting as guides upon stacking of said plurality of ink jet head chips, and said grooves are formed in an end surface on a nozzle hole side, or in an opposite side surface, of each of said plurality of ink jet head chips, and wherein said guide grooves of each ink jet head chip are substantially aligned with corresponding guide grooves of each other ink jet head chip in said stacked body; and wherein each of said ink jet head chips comprises an upper substrate, a middle substrate, and a lower substrate, and said plurality of grooves are formed in said middle substrate.

9. An ink jet recording apparatus comprising:

an ink jet head comprising:

a stacked body having a plurality of ink jet head chips stacked one on another at predetermined intervals; and a nozzle plate bonded with said stacked body; and wherein each of said ink jet head chips comprises:

a plurality of aperture portions for allowing ink drops to flow therethrough;

a plurality of ejection chambers connected to said plurality of aperture portions, respectively;

a plurality of diaphragms each constituting at least one wall of each of said ejection chambers; and a plurality of drivers that produce transformation in said diaphragms, respectively; and wherein said nozzle plate has a plurality of nozzle holes for ejecting the ink drops received from said aperture portions; and wherein each of said ink jet head chips further comprises a plurality of grooves for acting as guides upon stacking of said plurality of ink jet head chips, and said grooves are formed in an end surface on a nozzle hole side, or in an opposite side surface, of each of said plurality of ink jet head chips, and wherein said guide grooves of each ink jet head chip are substantially aligned with corresponding guide grooves of each other ink jet head chip in said stacked body; and wherein each of said ink jet head chips comprises an upper substrate, a middle substrate, and a lower substrate, and said plurality of grooves are formed in said middle substrate.

10. An ink jet head manufacturing method for manufacturing an ink jet head which comprises:

a stacked body having a plurality of ink jet head chips stacked one on another at predetermined intervals, each of said ink jet head chips comprising:

a plurality of nozzle holes for ejecting ink drops;

a plurality of ejection chambers connected to said plurality of nozzle holes respectively;

a plurality of diaphragms each constituting at least one wall of each of said ejection chambers respectively; and a plurality of drivers that produce transformation in said diaphragms, respectively; and wherein said method comprises the steps of:

forming a plurality of grooves, for acting as guides upon stacking said plurality of ink jet head chips, by anisotropic etching in an end surface on a nozzle side of each of said plurality of ink jet head chips;

preparing an alignment case, which is opened in its upper portion, and which is provided in the inner wall of its side portion with partition portions shaped in projecting strips for determining the intervals of the ink jet head chips, and including an alignment jig having pins, which is disposed the bottom of said alignment case so that the pins extend upward; and aligning said plurality of ink jet head chips by inserting the ink jet head chips between said partition portions of the alignment case and inserting said pins of the alignment jig into said plurality of grooves.

11. An ink jet head manufacturing method for manufacturing an ink jet head which comprises:

a stacked body having a plurality of ink jet head chips stacked one on another at predetermined intervals;

each of said ink jet head chips comprising:

a plurality of nozzle holes for ejecting ink drops;

a plurality of ejection chambers connected to said plurality of nozzle holes, respectively;

a plurality of diaphragms each constituting at least one wall of each of said ejection chambers, respectively; and a plurality of drivers that produce transformation in said diaphragms, respectively; and wherein said method comprises the steps of:

forming a plurality of grooves, for acting as guides upon stacking said plurality of ink jet head chips, by anisotropic etching in each of opposite side surfaces of each of said plurality of ink jet head chips;

preparing an alignment case, which is opened in its upper portion, and which is provided in the inner wall of its side portion with partition portions shaped in projecting strips for determining the intervals of the ink jet head chips, and which is provided in its side portion with a pair of windows;

fitting alignment jigs, each provided on its inside wall with alignment plates, into said windows; and aligning said plurality of ink jet head chips by inserting said alignment plates into said plurality of grooves.

* * * * *